US005171335A

United States Patent [19]

Kojima et al.

[11] Patent Number: 5,171,335

[45] Date of Patent: Dec. 15, 1992

[54] FILTER FOR COLLECTING FINE PARTICLES IN EXHAUST GAS

[75] Inventors: Akikazu Kojima, Gamagori; Shinji Miyoshi; Mitsuo Inagaki, both of Okazaki, all of Japan

[73] Assignee: Nippon Soken, Inc., Nishio, Japan

[21] Appl. No.: 773,527

[22] Filed: Oct. 9, 1991

[30] Foreign Application Priority Data

Oct. 10, 1990 [JP] Japan ..... 2-273036

[51] Int. Cl.[5] ..... B01D 39/20

[52] U.S. Cl. ..... 55/269; 55/523; 55/DIG. 10; 55/DIG. 30

[58] Field of Search ..... 55/267, 269, 523, DIG. 10, 55/DIG. 30

[56] References Cited

U.S. PATENT DOCUMENTS

| | | | |
|---|---|---|---|
| 4,276,071 | 6/1981 | Outland | 55/523 |
| 4,417,908 | 11/1983 | Pitcher, Jr. | 55/523 |
| 4,419,108 | 12/1983 | Frost et al. | 55/523 X |
| 4,420,316 | 12/1983 | Frost et al. | 55/523 |
| 4.427,418 | 1/1984 | Kogiso et al. | 55/523 X |
| 4.509,966 | 4/1985 | Dimick et al. | 55/523 X |
| 4,516,993 | 5/1985 | Takeuchi et al. | 55/DIG. 10 |
| 4,519,820 | 5/1985 | Oyobe et al. | 55/523 X |
| 4.535,589 | 8/1985 | Yoshida et al. | 55/DIG. 10 |
| 4,549,398 | 10/1985 | Oishi et al. | 55/DIG. 10 |
| 4.559,193 | 12/1985 | Ogawa et al. | 55/523 X |
| 4,643,749 | 2/1987 | Miura | 55/523 |
| 4,659,348 | 4/1987 | Mayer | 55/DIG. 30 |
| 4,667,469 | 5/1987 | Abthoff et al. | 55/523 X |
| 4,695,301 | 9/1987 | Okajima et al. | 55/523 |
| 4,704,863 | 11/1987 | Abtholff et al. | 55/523 X |
| 4,740,408 | 4/1988 | Mochida et al. | 55/523 X |
| 4,810,554 | 3/1989 | Hattori et al. | 55/523 X |
| 4,872,889 | 10/1989 | Lepperhoff et al. | 55/523 X |
| 4,881,959 | 11/1989 | Kono et al. | 55/523 X |
| 4,897,096 | 1/1990 | Pischinger et al. | 55/523 X |

FOREIGN PATENT DOCUMENTS

| | | | |
|---|---|---|---|
| 63-232817 | 9/1988 | Japan | 55/DIG. 10 |

*Primary Examiner*—Robert Spitzer

*Attorney, Agent, or Firm*—Cushman, Darby & Cushman

[57] ABSTRACT

A filter for collecting fine particles in exhaust gas is equipped with: a multitude of cells bordering on each other and allowing exhaust gas to flow therethrough; cell partitions separating these multitude of cells from each other and having a multitude of pores through which the multitude of cells communicate with each other; and stop sections provided in the end portions of the multitude of cells so as to cause the exhaust gas introduced into each of the cells at one end thereof to flow into the adjacent cells through the pores of the cell partitions and be discharged at the other end of the cell. These stop sections are so arranged that the amount of exhaust gas entering the cells at the central region of one of the end portions is smaller than that at the peripheral region of the same. With this construction, the amount of fine particles accumulated in the peripheral filter region is relatively large, and that in the central filter region is relatively small. Thus, an increase in temperature occurs in the peripheral filter region, whereas it is suppressed in the central filter region, so that the difference in temperature between the two regions is kept at a low level, thereby effectively protecting the filter from damage.

10 Claims, 10 Drawing Sheets

FILTER FOR COLLECTING FINE PARTICLES IN EXHAUST GAS

BACKGROUND OF THE INVENTION

1. Field of the Invention

This invention relates to a filter for collecting fine particles in exhaust gases discharged from combustion mechanisms such as diesel engines 2. Description of the Prior Art The exhaust pipe of a diesel engine is provided with a purifier for purifying the exhaust gas by collecting fine particles, such as carbon particles, contained in the gas. FIG. 16 shows an example of such a purifier.

In the drawing, a collecting filter 1 is formed as a cylindrical body having a honeycomb structure, which consists of a large number of cells 11 separated from each other by cell partitions 12 (FIG. 17), with adjacent cells 11 being alternately closed at the upstream and downstream ends thereof. Exhaust gas, introduced into the filter 1 at the upstream end thereof, enters those cells 11 which are open on the upstream side, and passes through the porous sections of the cell partitions 12 to flow into the adjacent cells 11, from which it is discharged to the downstream side. In this process, the fine carbon particles contained in the exhaust gas are arrested by the cell partitions 12 and accumulated thereon.

As this accumulation of fine particles progresses, the air-flow resistance of the filter increases, resulting in an increase in the differential pressure across the filter 1. Since this will cause the engine output to be lowered, it is necessary to periodically remove the accumulated fine particles. The removal is effected by, for example, a heater 5 provided on the upstream-side end surface of the filter 1 and serving to burn the collected fine particles.

A problem with this purification method by burning is that it involves an excessive temperature rise in the collecting filter, in particular, in the central portion thereof. Such a temperature rise will cause a large temperature gradient between the central portion of the filter and the peripheral portion thereof, which is at a relatively low temperature, resulting in the filter being damaged by heat. Further, in the low-temperatured peripheral portion of the filter, it often happens that some of the accumulated particles remain unburned, thus preventing perfect purification.

This situation is illustrated in the graph of FIG. 18. In this graph, the solid line represents changes in the temperature with passage of time in the central portion (the portion indicated at 14 in FIG. 16) of the filter 1, and the broken line represents those in the peripheral filter portion (the portion indicated at 15 in FIG. 16). The maximum temperature T1 in the central filter portion can become so high as to damage the filter 1. Further, due to the large temperature difference ΔT1 (approx. 300° C.) between the central and peripheral portions, this temperature involves an excessive temperature gradient The relatively low temperature in the peripheral region is due to the fact that the heat in this region is easily dissipated to the exterior through the tube wall of the container 3 lodging the filter.

An attempt to solve the problem of temperature rise in the central region is disclosed in, for example, Japanese Utility Model Unexamined Publication No. 59-152119, according to which the thickness of the cell partitions in the central region of the filter is made larger than that of the cell partitions in the peripheral filter region, that is, a difference in the level of wall thickness is provided across a predetermined boundary section between the two regions, thereby attaining an increase in heat capacity and avoiding a rapid temperature rise. This arrangement, however, involves a large difference in heat capacity across the boundary section where the cell-partition thickness changes, thereby causing a difference in temperature. Thus, with this proposed design, heat damage is liable to be caused in the boundary section mentioned above.

SUMMARY OF THE INVENTION

The present invention has been made with a view to solving the above problems. It is accordingly an object of this invention to provide a filter for collecting fine particles in exhaust gas which is capable of effectively avoiding damage during its recovery and which involves no inadequate recovery in the peripheral filter region.

To achieve the above object, this invention adopts a technical means in the form of a filter for collecting fine particles in exhaust gas.

In accordance with this invention, provided in the end portions of the multitude of cells are stop section, which are so arranged that the amount of exhaust gas allowed to enter the cells in the central region is smaller than that allowed to enter those in the peripheral region, so that a larger amount of exhaust gas flows through the peripheral region than in the central filter region.

Accordingly, the amount of fine particles accumulated in the peripheral filter region is larger than that accumulated in the central region.

Thus, in accordance with this invention, the accumulation pattern of fine particles is such that the amount of fine particles accumulated in the peripheral region is larger than that in the central region. Therefore, when burning these fine particles, an increase in temperature occurs in the peripheral filter region, whereas it is suppressed in the central region, so that the difference in temperature and, consequently, the temperature gradient, between the two regions, can be kept at a low level, thereby effectively protecting the filter from damage. Further, this arrangements helps to prevent the particles in the peripheral filter region from remaining unburnt.

BRIEF DESCRIPTION OF THE DRAWINGS

FIGS. 8 to 1 and FIGS. 13 and 14 are end views showing other embodiments of the filter of this invention, of which

DETAILED DESCRIPTION OF THE PREFERRED EMBODIMENTS

Figure 1A:
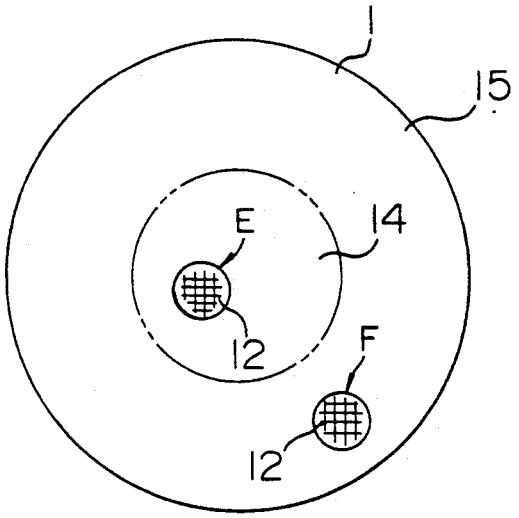
FIG. 1A is an end view of a filter in accordance with an embodiment of this invention.

Embodiments of this invention will now be described with reference to the accompanying drawings. In FIGS. 1A to 1C and FIGS. 3A to 3B, the reference numeral 1 indicates a filter, and the reference numeral 11 indicates a multitude of cells extending in the axial direction of the filter 1 and bordering on each other, each cell having a square sectional configuration. The reference numeral 12 indicates cell partitions separating the cells 11 from each other. As shown in FIG. 2, each of these cell partitions 12 has a multitude of pores 121, through which adjacent cells 11 communicate with each other. The size of these pores 121, which is in the order of several μm, is determined such that they allow the exhaust gas discharged from an automobile diesel engine to pass through them without allowing the passage of the fine carbon particles contained in the gas.

This filter 1 can be formed by extruding, for example, a cordierite-type ceramic material with a well-known honeycomb extrusion die and caking the extrusion. Thus, the cells 11 and the cell partitions 12 are all formed into an integral structure.

The reference numeral 13 indicates stop sections, which are formed by filling cell end portions with a ceramic adhesive, which may consist of cordierite or some other type of ceramic adhesive, such as Sumiceram or Allonceramic (both of which are commercial names). Due to the presence of these stop sections 13, which are situated at the open ends of the cells 11, the exhaust gas introduced into each cell 11 does not just flow through it to be directly discharged therefrom but flows into the adjacent cells 11 through the pores 121 of the cell partitions and is discharged from these adjacent cells. Accordingly, as shown in FIG. 3B, these stop sections 13 are arranged alternately, i.e., one for every two adjacent cells, at the open ends of the multitude of cells 11.

In this embodiment, the stop sections 13 are arranged in the following pattern: In the peripheral filter region 15, the stop sections 13 are arranged alternately, one for every two adjacent cells 11, as shown in FIG. 1C. Whereas, in the central filter region 14, the stop sections 13 are arranged in units each consisting of four adjacent cells, with these units being arranged alternately, i.e., one for every two adjacent units, as shown in FIG. 1B. As shown in FIG. 3B, every cell 11 equipped with a stop section at one end is open at the other end, and every cell 11 open at one end is equipped with a stop section at the other end. Thus, the fine carbon particles contained in exhaust gas are collected on the cell partitions 12 when the gas passes through them.

In this arrangement pattern for the stop sections 13, the following geometrical expressions can be respectively given to the exhaust-gas-passage area per unit sectional area in the central region 14 and that in the peripheral region 15:

$$a \cdot l \cdot n; \text{ and } 2a \cdot l \cdot n.$$

where a: the length of one side of a cell;

l: the axial length of the filter; and n: the number of cells per unit area

Accordingly, the peripheral region 15 offers double the passage plane of the central region 14, which means the peripheral region 15 has double the passage area of the central region 14.

Figure 4:
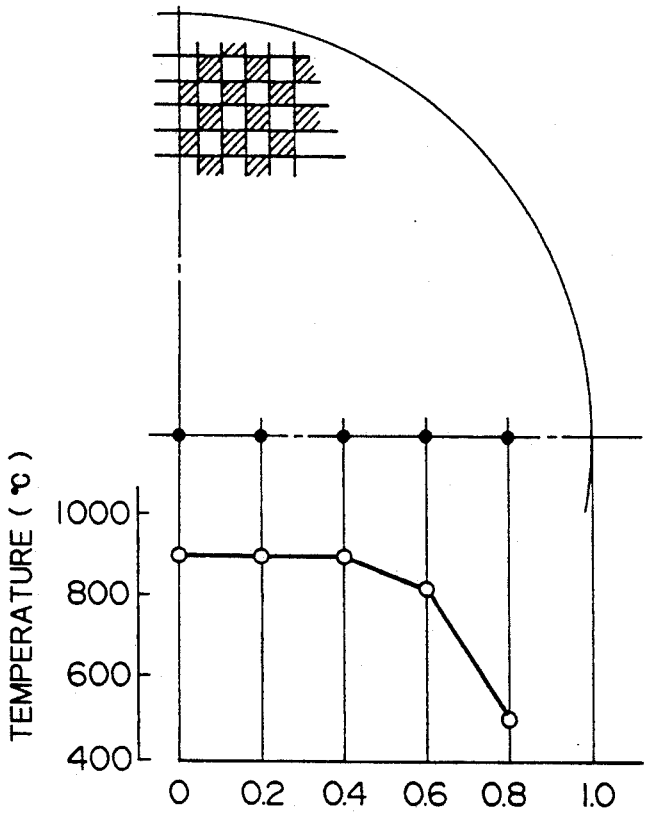
FIG. 4 is a characteristic chart for illustrating the present invention.

FIG. 4 is a graph showing the results of an experiment, in which was measured the temperature distribution in the axial direction of the filter 1 when it is being recovered. The sample used in the experiment had a diameter of 140 mm, an axial length of 130 mm, a volume of 2 lit., 150 cells, and a cell partition thickness of 0.45 mm, with one stop section being arranged for every two adjacent cells.

Figure 3A:
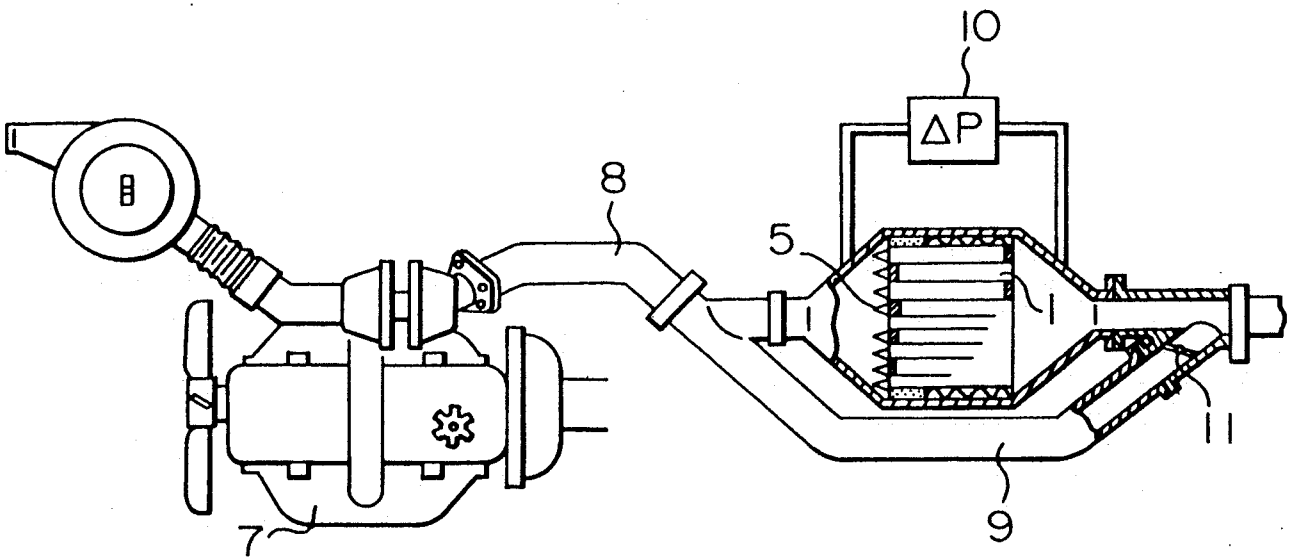
FIG. 3A is a partial section showing an example of a purifier using a filter in accordance with this invention.
Figure 3B:
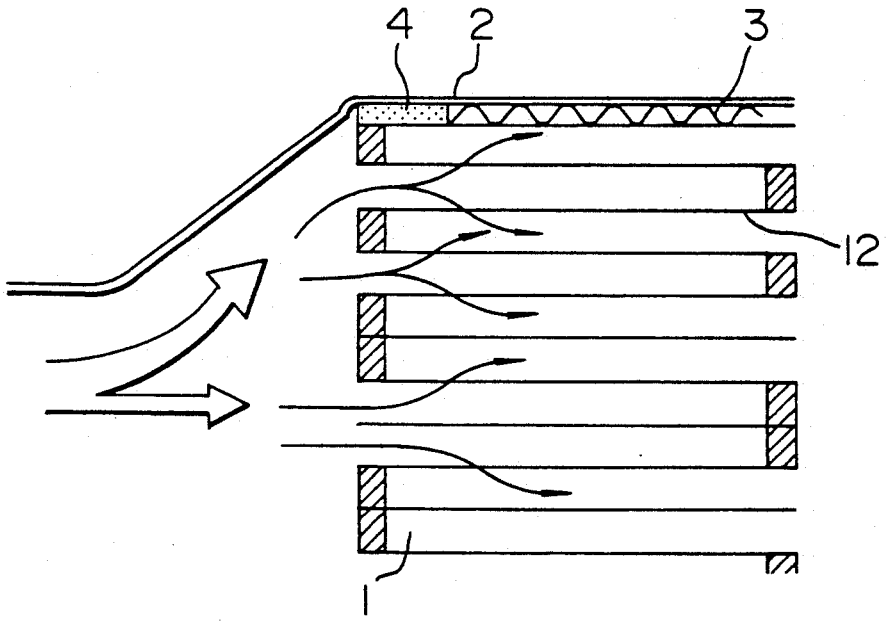
FIG. 3B is an enlarged sectional view showing the essential part of FIG. 3A.

Assuming that the radius of the filter l is 1, it will be understood that no great difference in temperature is to be observed, as compared with that of the central filter portion, within a range corresponding to approx. 0.6 of the filter diameter, whereas, in the range outer than that, a rapid decrease in temperature takes place due to the dissipation of heat through the container 2 (FIGS. 3A and 3B). If the outer portion of the filter is cooled down to a temperature below the ignition point of the carbon particles, those carbon particles in that portion will remain unburned. The above temperature measurement was performed by using a temperature sensor which is inserted into the filter.

Figure 1B:
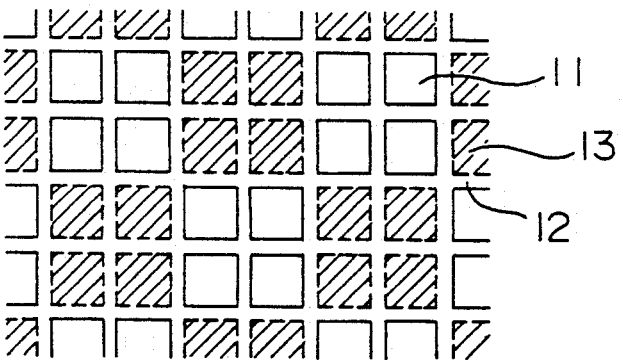
FIG. 1B is an enlarged view of the section E of FIG. 1A.
Figure 1C:
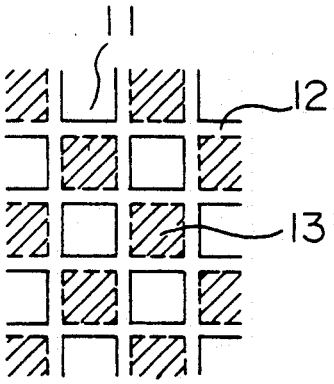
FIG. 1C is an enlarged view of the section F of FIG. 1A.
Figure 2:
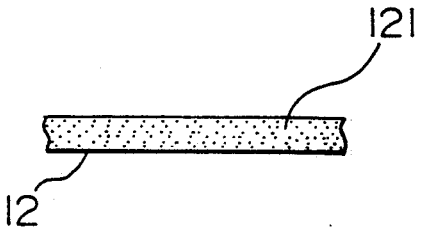
FIG. 2 is a detailed sectional view of a cell partition 12.

An appropriate measure for such a case is to change the arrangement pattern for the stop sections 13 in FIG. 1A across a boundary corresponding to somewhere between 0.6 and 0.7 of the radius of the filter 1. For example, when the filter shown in FIG. 1A is the same size as the above sample, a preferable diameter of the central region 14 of this filter will be approximately 100 mm.

Figure 5:
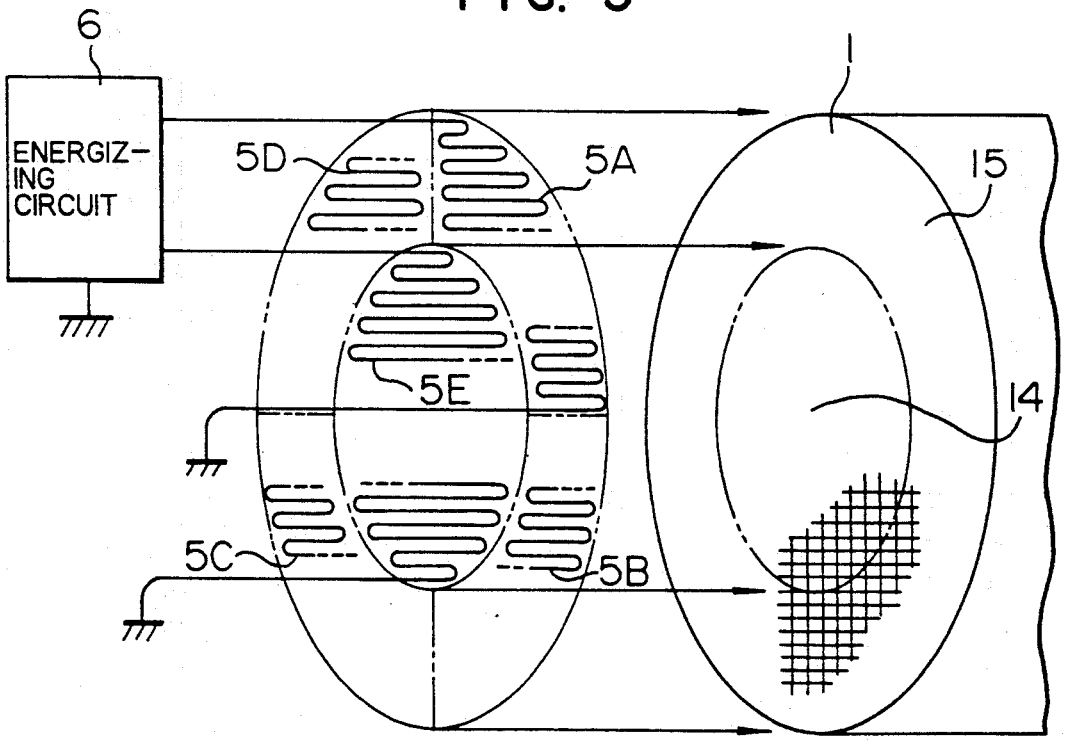
FIG. 5 is a perspective view illustrating a heater arrangement pattern for the filter of this invention.

As shown in FIG. 5, provided on the upstream-side end surface of this filter 1 for collecting fine particles are heaters 5A to 5E, which may be formed of a conductive ceramic material, nichrome wire, etc. These heaters 5A to 5E are respectively arranged on the end surface of the central filter region 14 and of four divisional sections of the peripheral filter region 15, and are connected to an external energizing circuit 6 (In the drawing, only the connection wirings for the heaters 5A and 5E are shown).

The energizing circuit 6 supplies electricity first to the heater 5A and then successively to the heaters 5B to 5D. After the fine particles in the peripheral filter region 15 have been burned away to complete the recovery of the region, the circuit 6 supplies electricity to the heater 5E to burn the fine particles in the central filter region 14.

Figure 7:
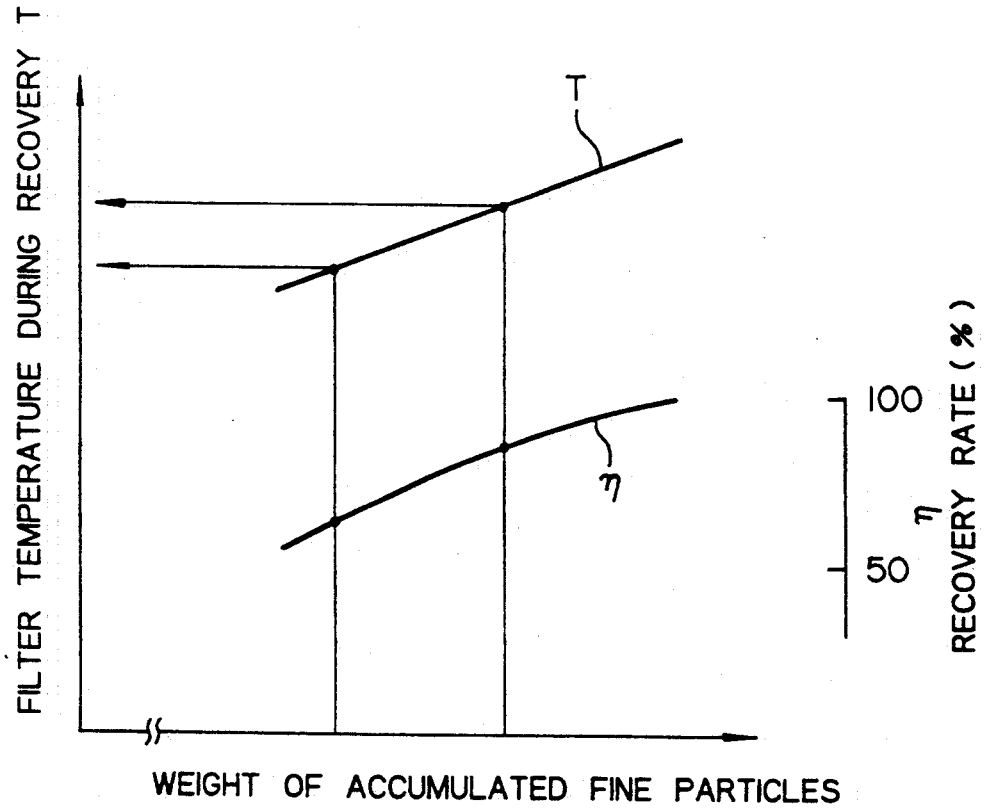

An experiment carried out by the present inventor indicated a close mutual relationship between the weight of the fine particles accumulated in the filter, the temperature inside the filter during recovery (the peak value thereof), and the recovery rate (the decreasing rate of the weight of the accumulated particles). As shown in FIG. 7, the larger the accumulation amount, the higher the recovery rate. However, that also entails an increase in the temperature inside the filter, causing, in some cases, the generation of cracks or even a fusion loss. A small accumulation amount, in contrast, enables the temperature inside the filter to be kept at a low level. However, in the peripheral filter portion, where heat is easily dissipated, such a low temperature can be short of the ignition point of the fine particles, with the result that some of the fine particles remain unburned. It will be understood from this that the accumulation amount should be small in the central filter portion, in which heat is hard to dissipate and which, consequently, attains a high temperature with ease, whereas, in the peripheral filter portion, where heat is easily dissipated to allow some of the particles to remain unburned, the accumulation amount should be large.

In accordance with this embodiment, the central region 14 of the filter 1 has, as shown in FIG. 3B, an exhaust-gas-passage area smaller than that of the peripheral region 15 thereof and, consequently, collects a larger amount of fine particles. This large amount of fine particles collected in the peripheral region 15 enables ignition and burning to take place with ease, thus enabling the filter to be recovered quickly. And, since the combustion heat generated in the peripheral region 15 is combined with the heat obtained by supplying electricity to the central heater 5E, the fine particles collected in the central filter region 14 can be ignited with ease even if their amount is small, thus effecting combustion quickly.

Figure 6:
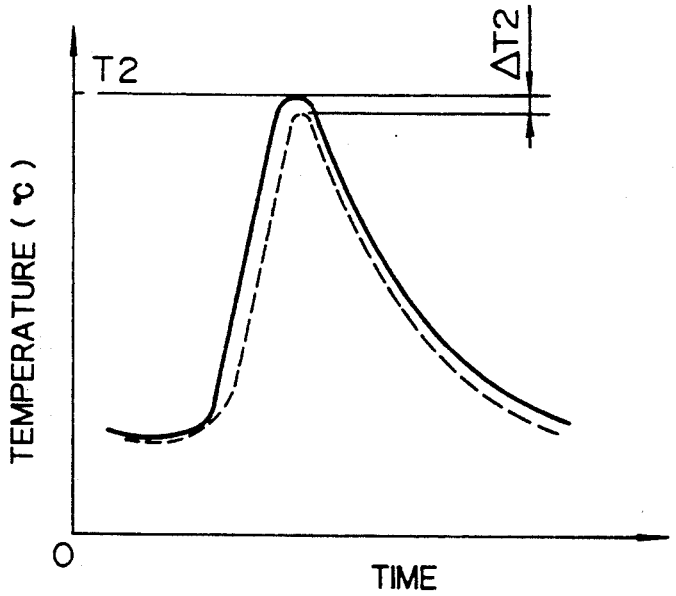
FIGS. 6 and 7 are characteristic charts for illustrating the present invention.

As started above, a larger amount of fine particles are collected in the peripheral filter region 15 in this burning recovery process, so that the burning temperature is allowed to rise there. In the central filter region 14, in contrast, the amount of fine particles collected is small, so that a rise in the burning temperature is suppressed. Thus, as shown in FIG. 6, the difference in temperature $\Delta T2$ between the central filter region (represented by the solid line) and the peripheral filter region (represented by the broken line) during recovery, is relatively small, and the maximum temperature T2 in the central filter region 14 is relatively low. As a result, the temperature gradient between the central filter region 14 and the peripheral filter region 15 is relatively small, and an excessive temperature rise in the central filter region 14 is avoided, thus effectively protecting the filter 1 from damage.

Further, due to the rise in temperature in the peripheral filter region 15, the fine particles are prevented from remaining unburned, thus making it possible to effect perfect recovery. FIGS. 6 and 7 show the results obtained with the filter shown in FIG. 14.

Further, the division of the heater in the peripheral region in this embodiment is made in consideration of the power capacity. When there is sufficient power available, the heaters 5A to 5D, or, further, 5A to 5E, may be united into a single filter. If, conversely, there is not enough power available, the filter may be further subdivided than in this embodiment.

The purifier shown in FIGS. 3A and 3B includes a cushioning material 3, a gas sealing material 4, an engine 7, an exhaust pipe 8, a by-pass pipe 9, and a differential pressure sensor 10. When clogging of the filter 1 caused by fine carbon particles is detected by a signal from the differential pressure sensor 10, electricity is supplied to the energizing circuit 6 of FIG. 5, and the valve 11 of the by-pass pipe is opened.

Figure 8:
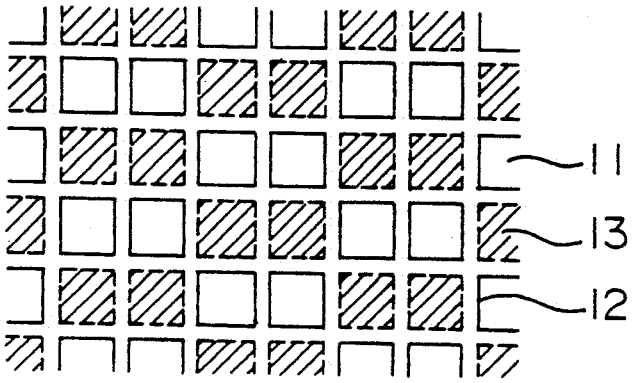
Figure 9:
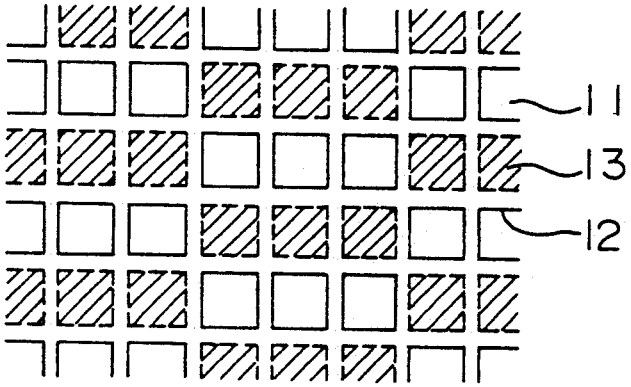
Figure 10:
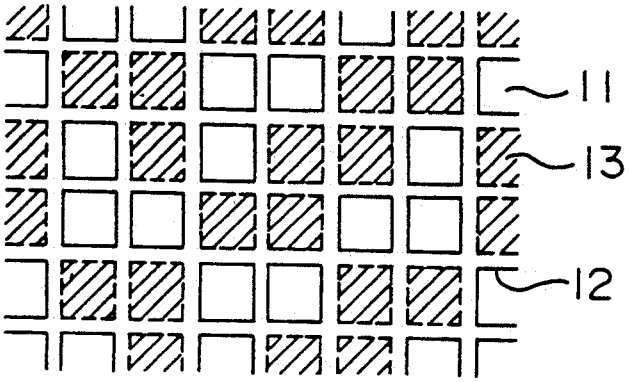

FIGS. 8 to 10 show other embodiments of the present invention. In these embodiments, the arrangement of the stop sections 13 in the central region is made on a unit-basis; the respective numbers of cells forming each unit of these embodiments are 2, 3 and 3. Regarding the peripheral region, the stop sections 13 are arranged on a cell-basis as in the above embodiment. The gas passage areas of the peripheral region in these embodiments are 4/3, 3/2 and 3/2, respectively, of the central-region gas passage area. In this way, the accumulation rate of fine carbon particles can be made different from that of the above embodiment.

Figure 11:
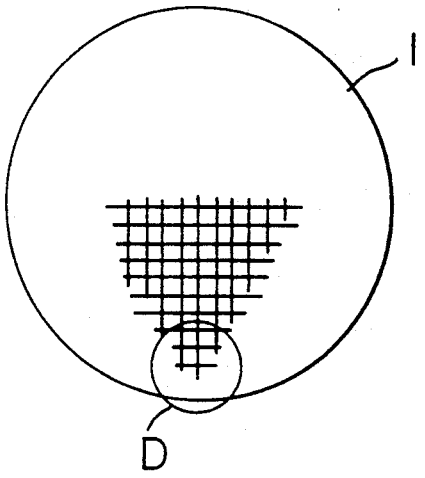
Figure 12:
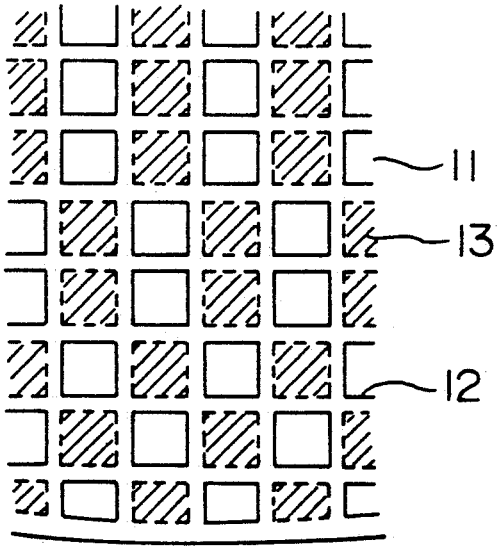
FIG. 12 is an enlarged view of the section D of FIG. 11.

FIGS. 11 and 12 show still further embodiments of this invention. In these embodiments, the distribution of the accumulation of carbon fine particles is gradually changed from the center of the filter 1 toward its periphery, thereby diminishing the temperature gradient in the radial direction of the filter 1. In the peripheral region, the stop sections 13 are arranged alternately, one for every two adjacent cells, and the arrangement pattern of the stop sections 13 is gradually changed towards the central portion, i.e., in 2-cell units, 3-cell units, etc.

Figure 13:
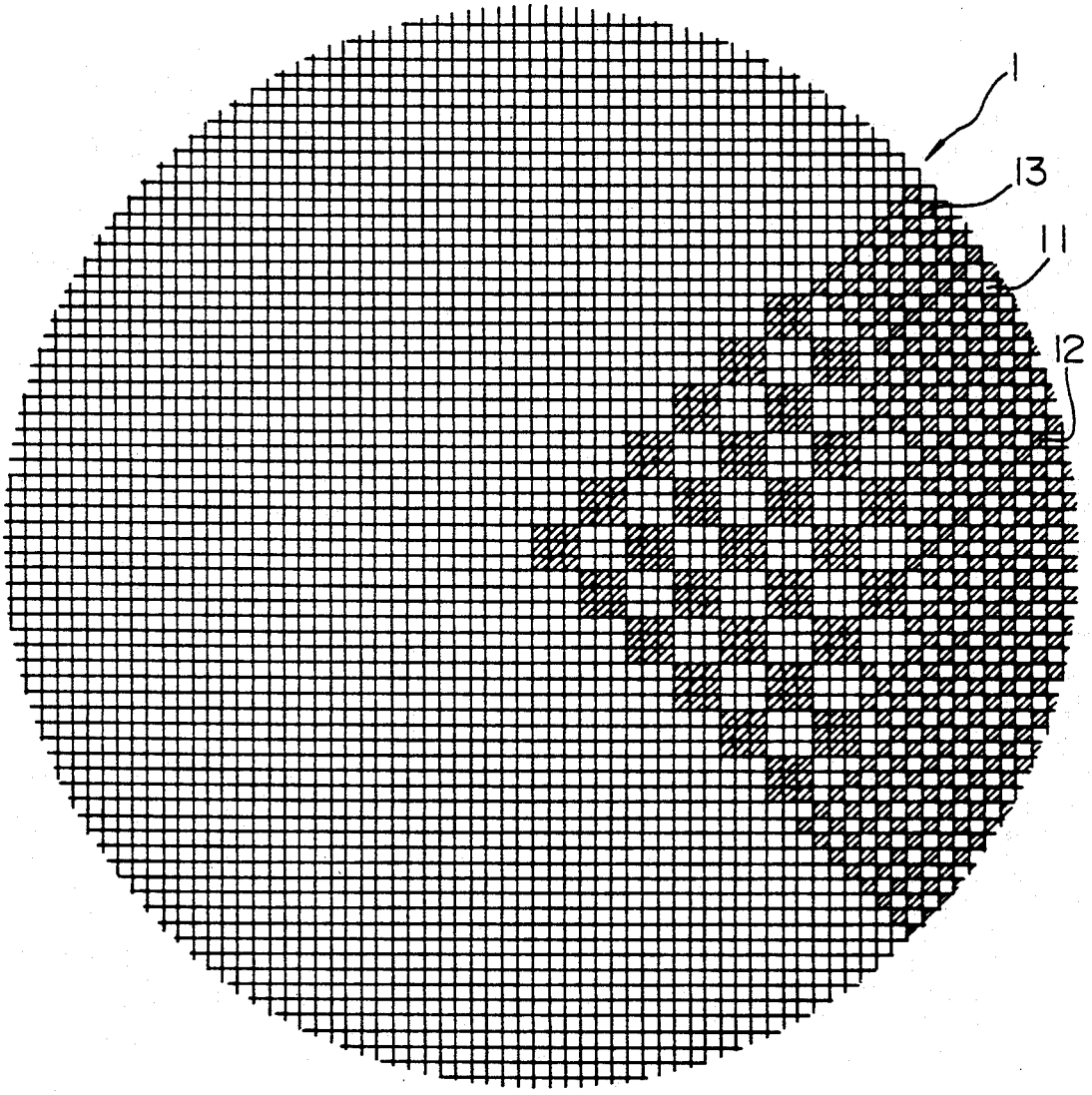
Figure 14:
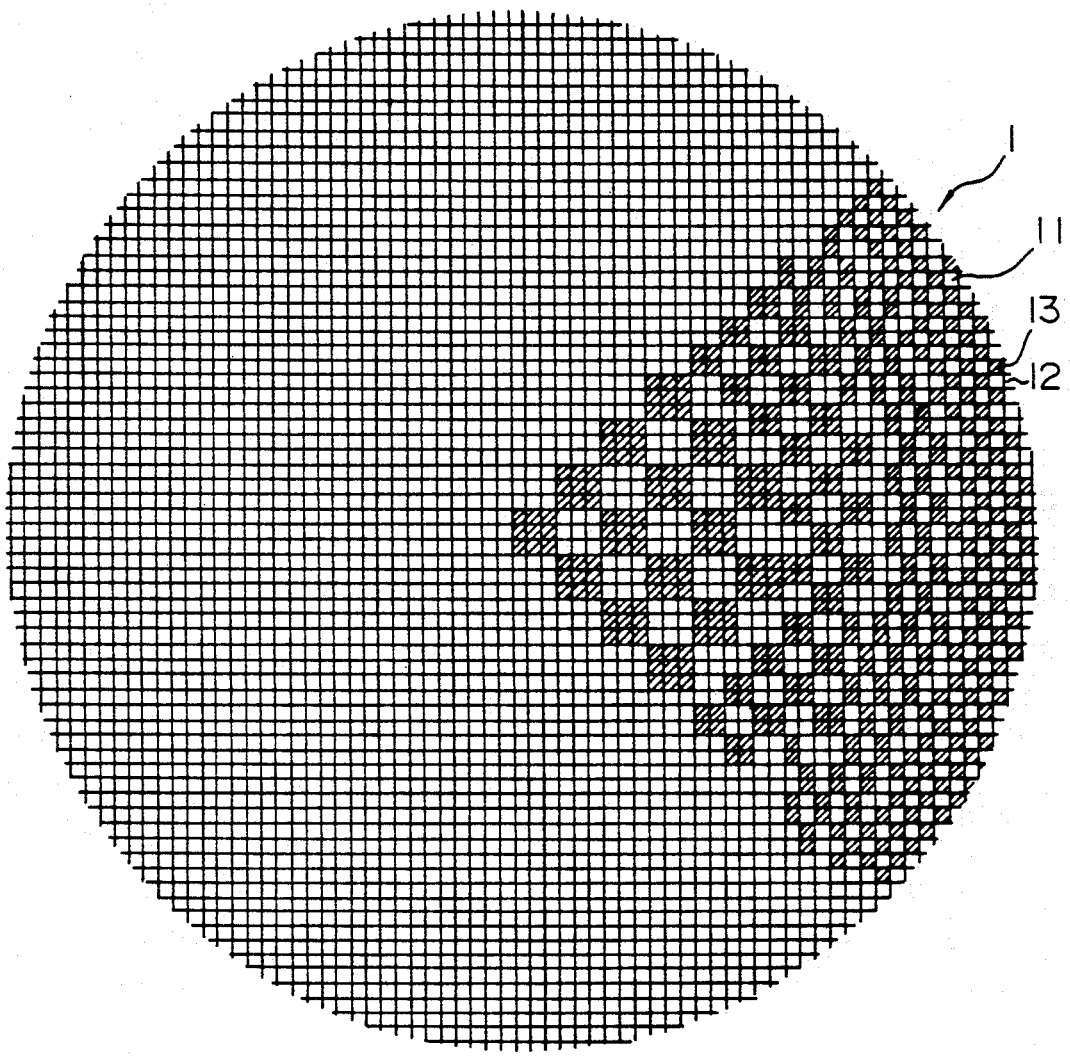

FIGS. 13 and 14 show still further embodiments of this invention. In the embodiment shown in FIG. 13, the stopping-section arrangement is made on a unit-basis in the central region 14, with each unit consisting of nine cells 11. The units are arranged alternately, one for every two adjacent units. In the peripheral region 15, the stop sections 13 are alternately on a cell-basis, i.e., one for every two adjacent cells.

In the embodiment shown in FIG. 14, the filter is divided into four regions: the central region 14, a first intermediate region adjacent, a second intermediate region, and the peripheral region 15. In the central region, the stop sections 13 are alternately arranged in 9-cell units, one for every two adjacent units. In the first intermediate region, which is adjacent to the central region, the stop sections 13 are alternately arranged in 4-cell units, one for every two adjacent units, and, in the second intermediate region, which is between the first intermediate region and the peripheral region, the stop sections 13 are alternately arranged in 2-cell units, one for every two adjacent units.

The filter shown in FIG. 13 is the one used in the experiment of FIGS. 4 and 7. The dimensions of this filter is as follows: diameter: 140 mm; length: 130 mm; volume: 2 lit.; number of cells: 150; cell wall thickness; 0.45 mm; and central region diameter: 100 mm.

Figure 15:
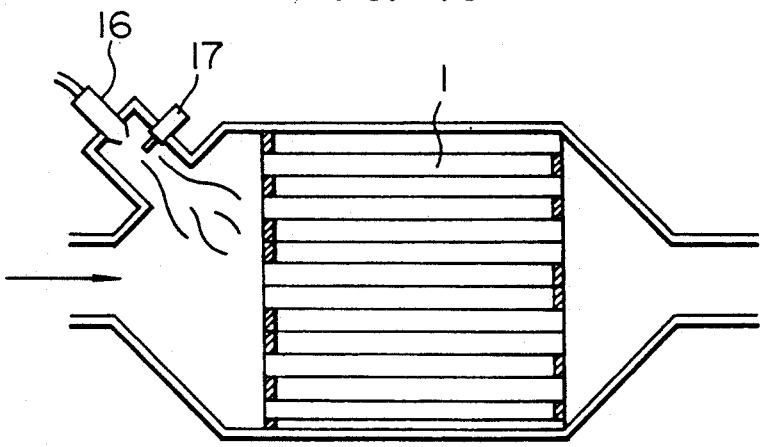
FIG. 15 is a sectional view showing an example of a filter recovery means.
Figure 16:
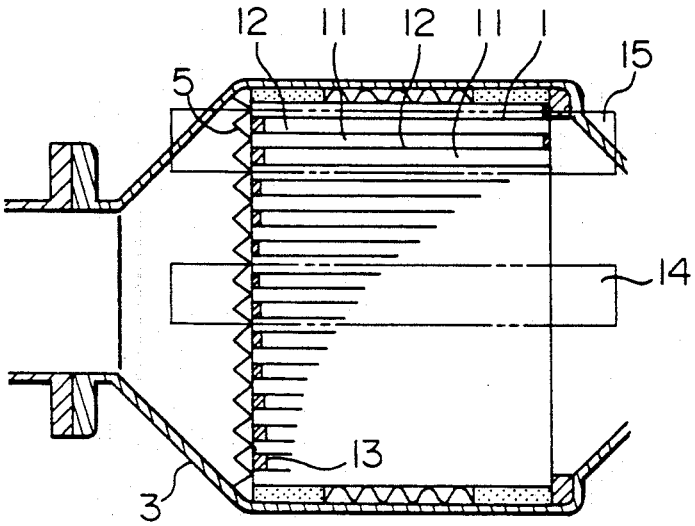
FIG. 16 PRIOR ART
FIG. 16 is a sectional view of a prior-art filter.
Figure 17:
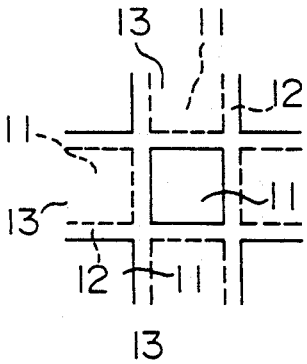
FIG. 17 PRIOR ART
FIG. 17 is an enlarged end view showing a part of the filter of FIG. 16.
Figure 18:
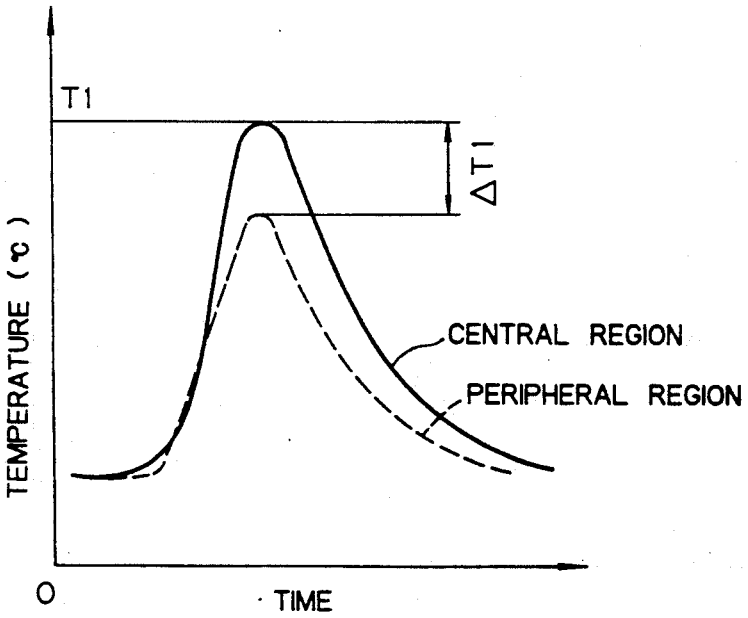
FIG. 18 is a characteristic chart for illustrating the prior-art filters.

FIG. 15 shows another example of the recovery means for the filter 1. This example consists of a burner 16 using light oil. The reference numeral 17 indicates an ignition plug.

In this invention, the kind of filter recovery means is not particularly limited; for example, it may also consist of a heater wire wound around the outer periphery of the filter.

What is claimed is:

1. A filter for collecting fine particles in exhaust gas, comprising:

a multitude of cells bordering on each other and allowing exhaust gas to flow therethrough;

cell partitions separating said multitude of cells from each other, said cell partitions having a multitude of pores through which said multitude of cells communicate with each other; and stop sections provided in end portions of said multitude of cells so as to cause the exhaust gas introduced into each of said cells at one end thereof to flow into adjacent cells through said pores of said cell partitions and be discharged at the other end of the cell; said stop sections being disposed so as to define a peripheral region and a central region of the filter, said peripheral region being disposed about a periphery of said central region; and said stop sections being so arranged that the amount of exhaust gas entering said cells at the central region of one of said end portions is less than that at the peripheral region of the same. .

2. A filter for collecting fine particles in exhaust gas as claimed in claim 1, wherein said central region extends radially outward from a center of the filter up to 0.7 of the radius of the filter.

3. A filter for collecting fine particles in exhaust gas as claimed in claim 1, wherein:

said stop sections are arranged in units in said central region, each unit including a predetermined number of cells bordering on and differing from each other in the inflow position of exhaust gas, units which correspond to said stop sections being arranged alternately one for every two adjacent units, and said stop sections are arranged in units in said peripheral region, each unit including a predetermined number of cells which is less than the number of cells of said central region, said cells bordering on and differing from each other in the inflow position of exhaust gas, units which correspond to said stop sections being arranged alternately one for every two adjacent units.

4. A filter for collecting fine particles in exhaust gas as claimed in claim 1, wherein:

said stop sections are arranged alternately one for every two adjacent cells in said peripheral region, bordering on each other and allowing or preventing the inflow of exhaust gas, and said stop sections are arranged in units each including four cells in said central region, bordering on and differing from each other in the inflow position of exhaust gas, units which correspond to said stop sections being arranged alternately one for every two adjacent units.

5. A filter for collecting fine particles in exhaust gas as claimed in claim 1, wherein:

said stop sections are arranged alternately one for every two adjacent cells in said peripheral region, bordering on each other and allowing or preventing the inflow of exhaust gas, and said stop sections are arranged in units each including nine cells in said central region, bordering on and differing from each other in the inflow position of exhaust gas, units which correspond to said stop sections being arranged alternately one for every two adjacent units.

6. A filter for collecting fine particles in exhaust gas as claimed in claim 1, wherein said stop sections are so arranged that the amount of exhaust gas entering said cells gradually diminishes from the peripheral region toward the central region.

7. A filter for collecting fine particles in exhaust gas as claimed in claim 6, wherein:

a first intermediate region adjacent to the central region and a second intermediate region adjacent to the peripheral region are provided between the central region, where said stop sections are arranged in units each including nine cells, and the peripheral region, where said stop sections are arranged one for every two adjacent cells capable of allowing or preventing the inflow of exhaust gas;

said stop sections are arranged in units in said first intermediate region, each unit including four cells, bordering on and differing from each other in the inflow position of exhaust gas, units which corresponds to said stop sections being arranged alternately one for every two adjacent units; and said stop sections are arranged in units in said second intermediate region, each unit including two cells, likewise bordering on and differing from each other in the inflow position of exhaust gas, units which correspond to said stop sections being arranged alternately one for every two adjacent units.

8. A filter for collecting fine particles in exhaust gas, comprising:

a multitude of cells bordering on each other and allowing exhaust gas containing fine particles to flow therethrough;

cell partitions separating said multitude of cells from each other, said cell partitions having a multitude of pores through which said multitude of cells communicate with each other;

stop sections being provided in end portions of said multitude of cells so that the exhaust gas, introduced into each of said cells at one end thereof, may flow into adjacent cells through said pores of said cell partitions to cause said fine particles to be collected by said cell partitions and so that said exhaust gas, from which said fine particles have been removed, may be discharged at the other end of cell, said stop sections being disposed so as to define a peripheral region and central region of the filter, said peripheral region being disposed about a periphery of said central region; and individual heating means provided on said peripheral and central regions of one of said end portions and serving to remove said fine particles by burning them;

said stop sections being so arranged that the amount of exhaust gas entering said cells at the central region of one of said end portions is less than that at the peripheral region of the same.

9. A filter for collecting fine particles in exhaust gas as claimed in claim 8, further comprising an energizing circuit for causing the heating means provided on the central region to generate heat after the heating means provided on the peripheral region has generated heat.

10. A filter for collecting fine particles in exhaust gas as claimed in claim 8, wherein said heating means are respectively arranged in five zones, one zone corresponding to said central region, and four zones being obtained by subdividing said peripheral region.

* * * * *